US010025236B2

(12) United States Patent
Sasame et al.

(10) Patent No.: US 10,025,236 B2
(45) Date of Patent: Jul. 17, 2018

(54) TRANSFER ROLLER AND IMAGE FORMING APPARATUS

(71) Applicant: CANON KABUSHIKI KAISHA, Tokyo (JP)

(72) Inventors: Hiroki Sasame, Ichikawa (JP); Shinsuke Kobayashi, Yokohama (JP); Takaaki Akamatsu, Yokohama (JP); Kohei Okayasu, Mishima (JP); Kenji Shindo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/619,910

(22) Filed: Jun. 12, 2017

(65) Prior Publication Data

US 2017/0363993 A1 Dec. 21, 2017

(30) Foreign Application Priority Data

Jun. 16, 2016 (JP) ..... 2016-119812

(51) Int. Cl.

| | |
|---|---|
| ***G03G 15/16*** | (2006.01) |
| ***G03G 15/06*** | (2006.01) |
| ***G03G 15/20*** | (2006.01) |
| ***G03G 15/00*** | (2006.01) |

(52) U.S. Cl.

CPC ..... *G03G 15/1685* (2013.01); *G03G 15/065* (2013.01); *G03G 15/1675* (2013.01); *G03G 15/2078* (2013.01); *G03G 15/657* (2013.01); *G03G 2215/00679* (2013.01); *G03G 2215/1623* (2013.01)

(58) Field of Classification Search

CPC ..... G03G 15/1685; G03G 15/065; G03G 15/1675; G03G 15/2078; G03G 15/657; G03G 2215/00679; G03G 2215/1623

See application file for complete search history.

(56) References Cited

U.S. PATENT DOCUMENTS

| | | | | |
|---|---|---|---|---|
| 7,486,919 | B2 | 2/2009 | Furuya | |
| 7,773,928 | B2 * | 8/2010 | Ogiyama | G03G 15/1675 399/315 |
| 9,274,462 | B2 * | 3/2016 | Yoshioka | G03G 15/1605 |

(Continued)

FOREIGN PATENT DOCUMENTS

| | | | |
|---|---|---|---|
| JP | 4639712 | B2 | 2/2011 |
| JP | 2012-155263 | A | 8/2012 |
| JP | 5116947 | B2 | 1/2013 |

*Primary Examiner* — Gregory H Curran

(74) *Attorney, Agent, or Firm* — Fitzpatrick, Cella, Harper & Scinto

(57) ABSTRACT

A relationship 150≤Rs (Ω)/Rm (Ω)≤4000 is established in an environment of a temperature of 15° C. and a humidity of 10% in a case where a surface resistance of a transfer roller is Rs (Ω) when a current is fed between a pair of electrodes facing each other in an axial direction of the transfer roller and arranged on a surface of the transfer roller with an interval of 5 mm therebetween, the electrodes having a width of 20 mm in a circumferential direction of the transfer roller in a state of being arranged on the transfer roller, and in a case where a combined resistance of a first layer and a second layer is Rm (Ω) when the current is fed from a core portion to an outer peripheral surface of the second layer.

9 Claims, 12 Drawing Sheets

(56) References Cited

U.S. PATENT DOCUMENTS

| | | | | |
|---|---|---|---|---|
| 2009/0232530 | A1 | 9/2009 | Saito et al. | |
| 2011/0194880 | A1* | 8/2011 | Ogawa | G03G 15/1685 399/313 |
| 2014/0105643 | A1 | 4/2014 | Saito et al. | |

* cited by examiner

TRANSFER ROLLER AND IMAGE FORMING APPARATUS

BACKGROUND OF THE INVENTION

Field of the Invention

The present invention relates to a transfer roller for transferring a developer formed on a photosensitive drum onto a sheet, and an image forming apparatus that forms an image on a sheet by using a developer.

Description of the Related Art

Conventionally, in an image forming apparatus such as a copier using an electrophotographic technology, a toner image is formed on a photosensitive drum when an electrostatic latent image formed on the photosensitive drum is developed by a developing apparatus. Then, the toner image formed on the photosensitive drum is transferred onto a recording member such as a sheet at the transfer nip portion between the photosensitive drum and a transfer roller. Specifically, when a voltage having a polarity opposite to that of toner is applied to the transfer roller, the toner image is transferred from the photosensitive drum onto the recording member at the transfer nip portion. After that, the recording member onto which the toner image has been transferred is separated from the photosensitive drum and heated and pressed by a fixing apparatus. Thus, the toner image is fixed onto the recording member. In the manner described above, an image is formed on the recording member.

Here, the transfer roller is constituted by, for example, a conductive shaft having a function as an electrode and a cylindrical elastic layer that covers the outer peripheral surface of the conductive shaft. As the elastic layer, a semiconductive rubber material such as EPDM, NBR, urethane rubber, epichlorohydrin, and silicon rubber is generally used. In addition, in order to cause the outer peripheral surface of the photosensitive drum and the outer peripheral surface of the transfer roller to uniformly come in contact with each other, the elastic layer of the transfer roller may be foamed to form a cell structure near the surface of the transfer roller.

In addition, in order to satisfactorily retain an image formed on the recording member, it is necessary to cause the recording member to stably retain an unfixed toner image at the transfer nip portion. Therefore, charges having a polarity opposite to that of the toner are conventionally applied from the transfer roller onto the rear surface (surface on a side opposite to a surface on which an image is to be formed) of the recording member. If the amount of the charges applied onto the rear surface of the recording member is small, a force with which the recording member retains the toner image is decreased, whereby the toner image on the recording member may be scattered due to an impact occurring when the recording member is transported. In this case, an image failure occurs in an image formed on the recording member (commonly known as "scattering").

Particularly, when the electric resistance of the recording member is high or when an environment temperature is low, the amount of the charges applied onto the rear surface of the recording member becomes insufficient, whereby the amount of the charges retained on the rear surface of the recording member may become insufficient. It is possible to increase the amount of the charges applied onto the rear surface of the recording member with an increase in a voltage applied to the transfer roller. However, if the voltage applied to the transfer roller is excessively increased, the polarity of the toner transferred onto the recording member is inverted. In this case, there is a likelihood that the toner on the recording member is caused to have the same polarity as that of the voltage applied to the transfer roller and the toner with its polarity inverted is transferred from the recording member onto the photosensitive drum again. As a result, part of an image formed on the recording member is likely to be lacked (commonly known as "re-transfer"). Therefore, according to a technology disclosed in Japanese Patent Application Laid-open No. 2012-155263, the amount of the charges retained on the rear surface of the recording member is increased while "re-transfer" is prevented. Specifically, an elastic layer having a cell structure is formed near the surface of the transfer roller, and the diameter of cells near the surface of the elastic layer is increased.

SUMMARY OF THE INVENTION

With an increase in the diameter of the cells, irregularities may be formed on the surface of the transfer roller, and the interval between the surface of the transfer roller and the recording member may be increased. Thus, since a discharge is promoted between the surface of the transfer roller and the recording member, the amount of the charges applied onto the rear surface of the recording member may be increased. Therefore, the force with which the recording member retains the toner may be improved, and the occurrence of an image failure may be suppressed.

However, according to the technology disclosed in Japanese Patent Application Laid-open No. 2012-155263, the intensity of the discharge occurring between the surface of the transfer roller and the recording member is fluctuated, whereby a toner image is not satisfactorily transferred from the photosensitive drum onto the recording member. This is because the difference between the distance between portions close to the recording member and the recording member and the distance between portions far from the recording member and the recording member becomes larger as the diameter of the cells is larger at the surface of the cells positioned near the surface of the transfer roller. Particularly, for a half-tone image, undesired shading occurs in an image formed on the recording member when a toner image is not satisfactorily transferred from the photosensitive drum onto the recording member (commonly known as "roughness").

Therefore, it is an object of the present invention to cause a recording member to stably retain a toner image transferred thereon.

In order to achieve the above object, an embodiment of the present invention provides a transfer roller for transferring a developer image formed on a photosensitive drum onto a sheet, the transfer roller comprising:

a conductive core portion:

a first layer that covers the core portion; and a second layer that covers the first layer, wherein the developer image is transferred onto the sheet at a nip portion between the photosensitive drum and the transfer roller when a voltage is applied to the core portion, and a relationship $150 \leq Rs\ (\Omega)/Rm\ (\Omega) \leq 4000$ is established in an environment of a temperature of 15 C and a humidity of 10% in a case where a surface resistance of the transfer roller is Rs (Ω) when a current is fed between a pair of electrodes facing each other in an axial direction of the transfer roller and arranged on a surface of the transfer roller with an interval of 5 mm therebetween, the electrodes having a width of 20 mm in a circumferential direction of the transfer roller in a state of being arranged on the transfer roller, and in a case where a combined resistance of the first layer and the second layer is Rm (Ω) when the current is fed from the core portion to an outer peripheral surface of the second layer.

In addition, another embodiment of the present invention provides an image forming apparatus comprising:

the transfer roller; and a photosensitive drum, wherein an image is formed on a sheet when a developer image formed on the photosensitive drum is transferred onto a sheet.

According to an embodiment of the present invention, it is possible to cause a recording member to stably retain a toner image transferred thereon.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment (Image Forming Apparatus M)

Figure 1:
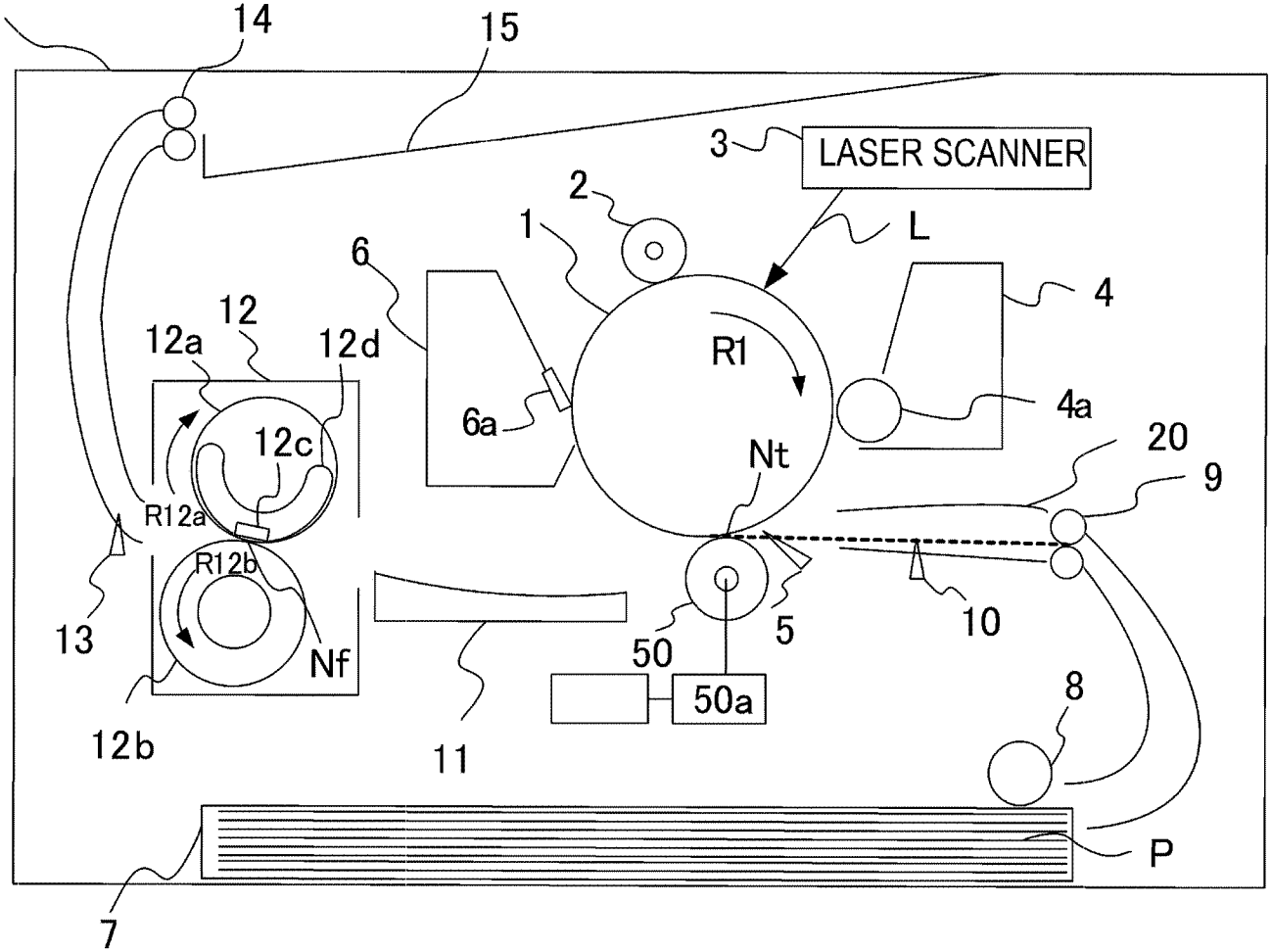
FIG. 1 is a schematic cross-sectional view of an image forming apparatus according to a first embodiment.

FIG. 1 is a schematic cross-sectional view of an image forming apparatus M according to a first embodiment. First, a description will be given, with reference to FIG. 1, of the configuration of a laser beam printer (hereinafter called the image forming apparatus M). The image forming apparatus M shown in FIG. 1 has a photosensitive drum 1 serving as a drum-type electrophotographic photosensitive member. The photosensitive drum 1 is formed in such a manner that a layer made of a photosensitive material such as an organic photo conductor (OPC), amorphous selenium, and amorphous silicon is provided on a cylinder drum substrate made of aluminum, nickel, or the like. The photosensitive drum 1 is rotatably supported inside the image forming apparatus M and rotationally driven by a driving source (not shown) at a prescribed process speed in a direction indicated by an arrow R1 in FIG. 1.

Around the photosensitive drum 1, a charging roller 2, an exposing unit 3, a developing apparatus 4, a transfer roller 50, and a cleaning apparatus 6 are sequentially disposed along the rotating direction of the photosensitive drum 1. In addition, at the bottom of the image forming apparatus M, a sheet feeding cassette 7 is disposed in which recording members P serving as sheets such as papers are accommodated. Further, along a path on which the recording members P are to be transported, a sheet feeding roller 8, a transporting roller 9, a transporting frame 20, a top sensor 10, a pre-transfer guide 5 (guide member), a transporting guide 11, a fixing apparatus 12, a sheet discharging sensor 13, a sheet discharging roller 14, and a sheet discharging tray 15 are sequentially disposed.

Next, a description will be given of the operation of the image forming apparatus M. The photosensitive drum 1 rotationally driven by the driving source (not shown) in the direction indicated by the arrow R1 is uniformly charged by the charging roller 2 so as to have a prescribed polarity and potential. On the surface of the charged photosensitive drum 1, laser light L is exposed based on image information from the exposing unit 3 such as a laser optical system. Thus, since charges at a portion exposed by the laser light L are removed, an electrostatic latent image is formed on the surface of the photosensitive drum 1. Then, the electrostatic latent image is developed by the developing apparatus 4. The developing apparatus 4 has a developing roller 4*a*. When a developing bias is applied to the developing roller 4*a*, toner serving as a developer is attached to the electrostatic latent image on the photosensitive drum 1. Thus, the electrostatic latent image on the photosensitive drum 1 is developed as a toner image serving as a developer image.

The toner image formed on the photosensitive drum 1 is transferred onto a recording member P such as a paper by the transfer roller 50. The transfer roller 50 is pressed against the photosensitive drum 1 by a transfer pressing spring (not shown) and forms a transfer nip portion Nt with the photosensitive drum 1. The recording member P is accommodated in the sheet feeding cassette 7 and fed one at a time by the sheet feeding roller 8. Then, the recording member P is transported by the transporting roller 9 to enter the transfer nip portion Nt between the photosensitive drum 1 and the transfer roller 50 while being guided by the pre-transfer guide 5. At this time, after the top sensor 10 detects the arrival of the tip end of the recording member P at the top sensor 10, the toner image on the photosensitive drum 1 and the recording member P are synchronized with each other. Further, a transfer voltage having a polarity opposite to that of the toner is applied to the transfer roller 50 from a transfer voltage power supply 50*a*. Thus, the toner image on the photosensitive drum 1 is transferred onto the prescribed position of the recording member P.

The recording member P onto which the unfixed toner image has been transferred is transported to the fixing apparatus 12 along the transporting guide 11. Then, the unfixed toner image on the recording member P is heated and pressed by the fixing apparatus 12 to be fixed onto the surface of the recording member P. Here, in the embodiment, the fixing apparatus 12 is a pressing-roller-driving-type fixing apparatus that uses a flexible endless belt as a fixing film. The fixing apparatus 12 has a fixing film 12*a* serving as a film-shaped rotating member, a pressing roller 12*b* that comes in contact with the fixing film 12*a*, and a heater 12*c* that heats the toner via the fixing film 12*a*. In addition, the fixing apparatus 12 has a heater holder 12*d* that supports the heater 12*c*.

Here, the pressing roller 12*b* is formed in such a manner that a heat-resisting elastic layer having elasticity such as silicon rubber is provided on the outer peripheral surface of a metal core bar. Further, the outermost layer of the pressing roller 12*b* is a releasable layer made of a high releasable material such as a fluorocarbon resin. Then, when the pressing roller 12*b* presses the fixing film 12*a* against the heater 12*c* by the operation of a pressing spring (not shown), a fixing nip portion Nf is formed between the fixing film 12*a* and the pressing roller 12*b*. Further, the pressing roller 12*b* is rotationally driven by a driving source (not shown) in a direction indicated by an arrow R12*b* in FIG. 1. Thus, the fixing film 12*a* rotates with a frictional force generated between the pressing roller 12*b* and the fixing film 12*a* at the fixing nip portion Nf. The fixing film 12*a* rotates in a direction indicated by an arrow R12*a* with its inner peripheral surface adhering closely to and sliding on the lower surface of the heater 12*c*.

Further, the temperature of the heater 12*c* rises when power is supplied to the heater 12*c*. In a state in which the temperature of the heater 12*c* rises to a prescribed temperature, the recording member P onto which the unfixed toner image has been transferred enters the place between the fixing film 12*a* and the pressing roller 12*b* (the fixing nip portion Nf). At this time, the surface of the recording member P onto which the toner image has been transferred adheres closely to the outer peripheral surface of the fixing film 12*a*. As the fixing film 12*a* rotates, the recording member P is held and transported between the fixing film 12*a* and the pressing roller 12*b* at the fixing nip portion Nf. In a process in which the recording member P is held and transported at the fixing nip portion Nf, the heat of the heater 12*c* is transferred to the recording member P via the fixing film 12*a*. Thus, when the unfixed toner image on the recording member P is heated and pressed, the toner image is melted and fixed onto the recording member P. Then, the recording member P that has passed through the fixing nip portion Nf is separated from the fixing film 12*a*.

The recording member P onto which the toner image has been fixed is discharged by the sheet discharging roller 14 onto the sheet discharging tray 15 provided on the upper surface of the image forming apparatus M. On the other hand, toner that has remained on the photosensitive drum 1 after the transfer of the toner image onto the recording member P is removed by a cleaning blade 6*a* of the cleaning apparatus 6. When the above operations are repeatedly performed, an image is successively formed on the recording members P.

(Winding Angle α and Transfer Separating Angle β)

Figure 2:
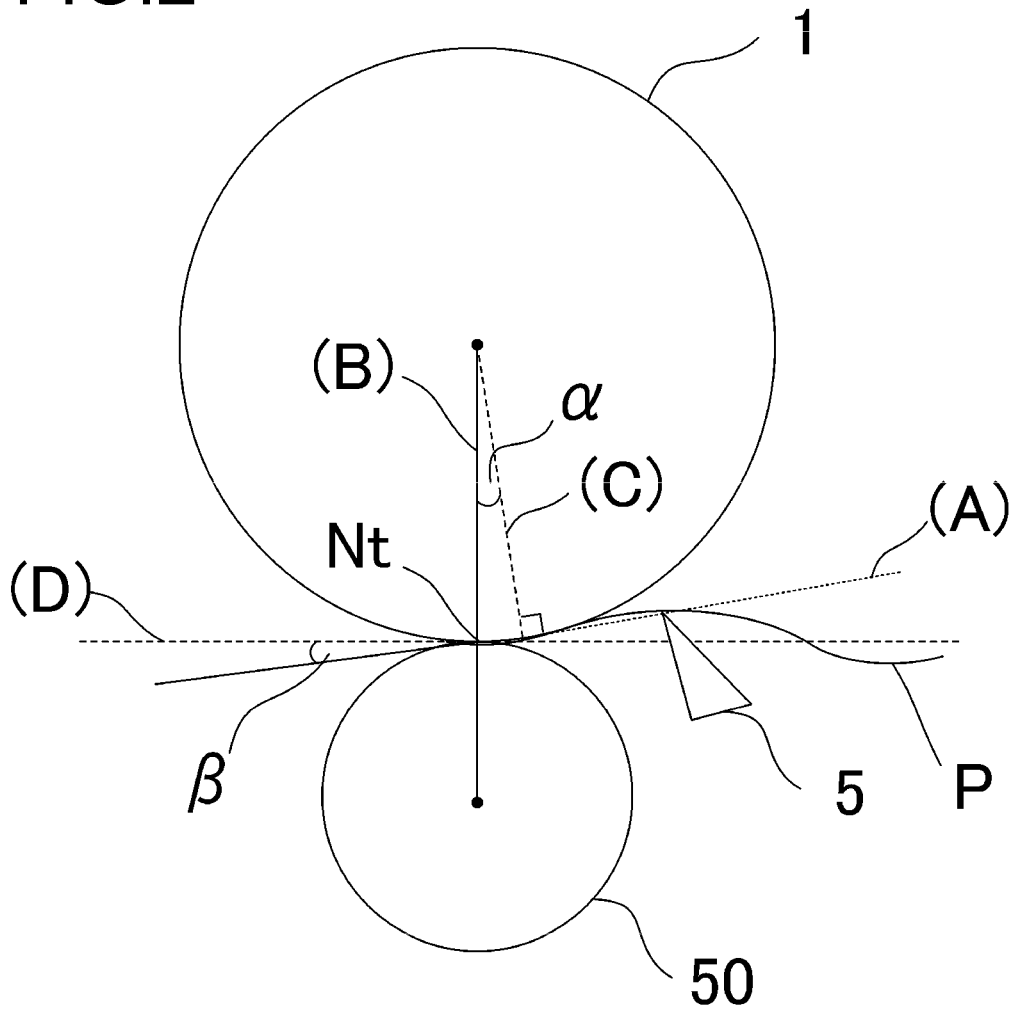
FIG. 2 is a view showing the transfer nip portion between a photosensitive drum and a transfer roller according to the first embodiment.

Next, a description will be given of the definitions of a winding angle α at which the recording member P winds around the photosensitive drum 1 and a transfer separating angle β. FIG. 2 is a view showing the transfer nip portion Nt between the photosensitive drum 1 and the transfer roller 50 according to the first embodiment. FIG. 2 schematically shows the angle (winding angle α) at which the recording member P winds around the photosensitive drum 1 and the transfer separating angle β when the recording member P is transported to the transfer nip portion Nt.

As shown in FIG. 2, the recording member P transported by the transporting roller 9 is transported to the transfer nip portion Nt while being guided by the pre-transfer guide 5. Specifically, the recording member P is transported to the transfer nip portion Nt from a side closer to the photosensitive drum 1 than the transfer roller 50. At this time, a tangent passing through the top of the pre-transfer guide 5 among tangents to the outer peripheral surface of the photosensitive drum 1 is a straight line A serving as a first line, and a line segment connecting the center of the photosensitive drum 1 and the center of the transfer roller 50 to each other is a line segment B serving as a second line. Specifically, the straight line A is a tangent of which the contact with the photosensitive drum 1 is closer to the transfer nip portion Nt among tangents from the portion closest to the transfer nip portion Nt to the outer peripheral surface of the photosensitive drum 1 among portions at which the pre-transfer guide 5 and the recording member P contact each other. In addition, a line segment from the contact between the outer peripheral surface of the photosensitive drum 1 and the straight line A to the center of the photosensitive drum 1 is a line segment C serving as a third line. Moreover, an angle formed by the line segment B and the line segment C is the winding angle α.

At this time, the winding angle α is positive when the line segment C is positioned on the upstream side of the line segment B in the rotating direction of the photosensitive drum 1. That is, the winding angle α is negative when the line segment C is positioned on the downstream side of the line segment B in the rotating direction of the photosensitive drum 1. In addition, a tangent passing through the center of the transfer nip portion Nt and vertically crossing the line segment B among the tangents to the outer peripheral surface of the photosensitive drum 1 is a transfer nip line D. Moreover, an angle formed by the recording member P and the transfer nip line D on the downstream side of the transfer nip portion Nt in the transporting direction of the recording member P is the transfer separating angle β. At this time, the transfer separating angle β is positive when the recording member P comes out on the side of the transfer roller 50 with respect to the transfer nip line D, and the transfer separating angle β is negative when the recording member P comes out on the side of the photosensitive drum 1 with respect to the transfer nip line D. Note that the winding angle α in the embodiment is −2°.

(Transfer Roller 50)

Figure 3:
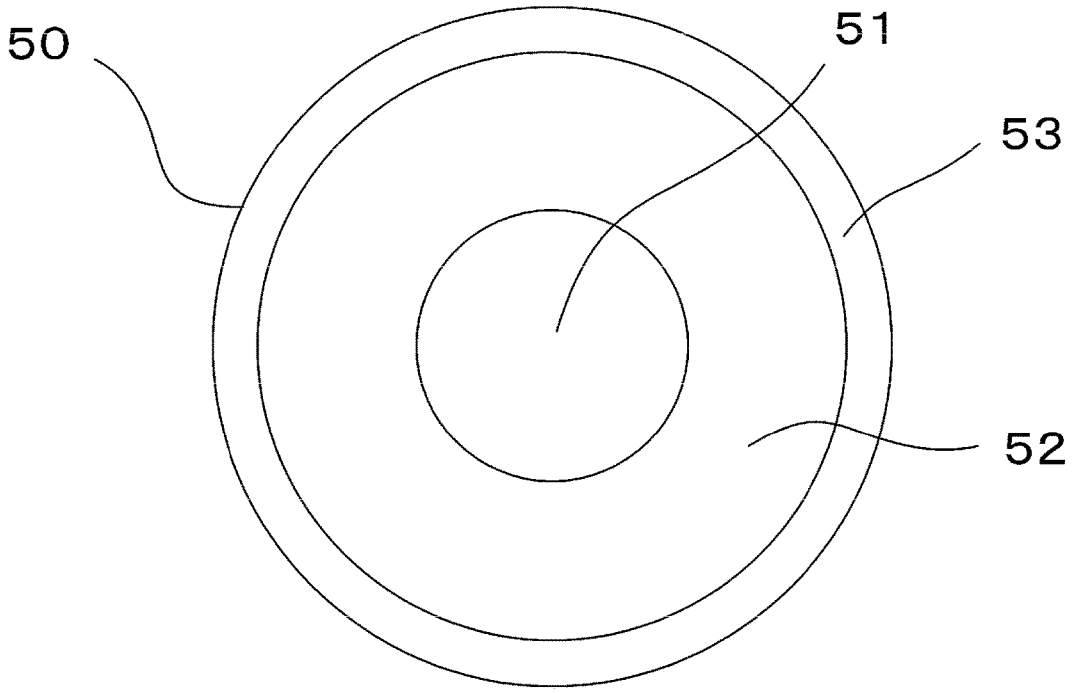
FIG. 3 is a cross-sectional view of the transfer roller according to the first embodiment.

Next, a description will be given of the configuration of the transfer roller 50 according to the embodiment. FIG. 3 is a cross-sectional view of the transfer roller 50 according to the first embodiment. As shown in FIG. 3, the transfer roller 50 is constituted by a core bar 51 serving as a core portion, an elastic layer 52 serving as a cylindrical first layer coating the outer peripheral surface of the core bar 51, and an elastic layer 53 serving as a second layer coated on the elastic layer 52. Here, the transfer roller 50 has a length of 216 mm in its longitudinal direction (rotational center axial direction) and has an outer diameter φ of 12.5 mm, and the core bar 51 has an outer diameter φ of 5 mm. In addition, the elastic layer 52 has a thickness of 3 mm, and the elastic layer 53 has a thickness of 0.75 mm and a hardness (Asker C hardness) of 30°. Moreover, the transfer roller 50 presses the photosensitive drum 1 with a force of 9.8 N (1 kgf).

Here, in the embodiment, a resistance value of the surface of the transfer roller 50 and a resistance value in the radial direction of the transfer roller 50 are adjusted. Therefore, in the embodiment, the two layers of the elastic layers 52 and 53 are provided on the transfer roller 50, and the resistance values of the elastic layers 52 and 53 are set to be different from each other. Specifically, in the embodiment, the resistance value of the elastic layer 53 is set to be smaller than that of the elastic layer 52. In addition, the elastic layer 53 is made of a foaming elastic member having a cell structure.

(Method for Measuring Cell Diameter of Elastic Layer 53)

Figure 4B:
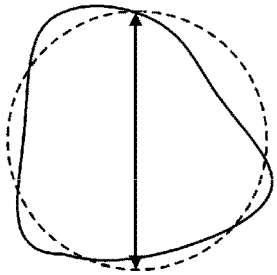
FIGS. 4A to 4C are views showing a method for measuring the diameter of the cells of a foaming material used in the transfer roller.
Figure 4C:
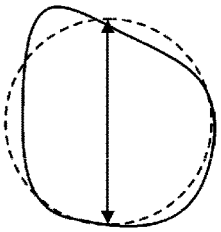
Figure 4A:
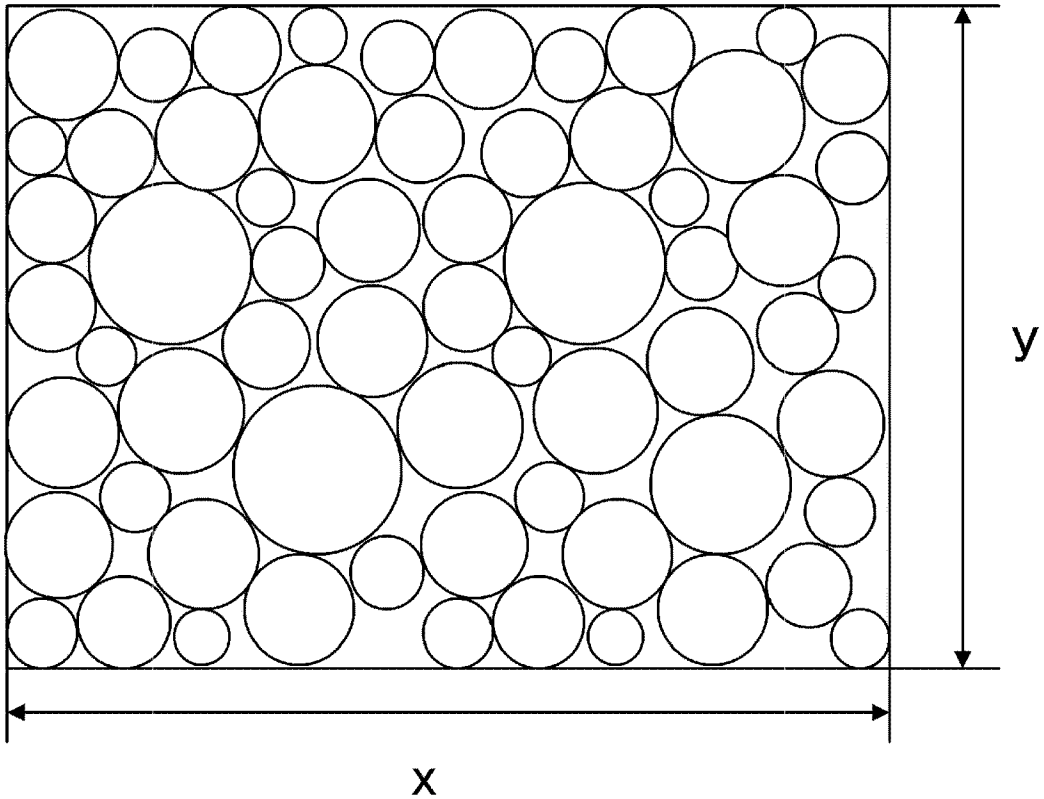

Next, a description will be given of a method for measuring the cell diameter of the elastic layer 53 of the transfer roller 50. The surface layer of the transfer roller 50 was observed using a laser microscope VHX-1000 (manufactured by Keyence Corporation) and a 400-fold lens (VH-Z100R). Then, the outer diameters of cells constituting the elastic layer 53 were measured from an image obtained by the observation. Here, FIGS. 4A to 4C are views showing a method for measuring the diameters of the cells of a foaming material used in the transfer roller 50. FIG. 4A schematically shows an image obtained when the surface layer of the transfer roller 50 was observed with the laser microscope having a magnification of 100 folds.

As shown in FIG. 4A, the image obtained by the laser microscope has an infinite number of cells. In the embodiment, the diameters of 30 larger cells among the cells in the image are measured, and an average of the diameters is regarded as the cell diameter of the transfer roller 50. In addition, the laser microscope has a viewing angle x×y of 3 mm×4 mm (a range of 3 mm long by 4 mm broad at the surface of the elastic layer 53). Here, the cells constituting the elastic layer 53 do not necessarily have a shape close to that of a true circle. For example, as shown in FIGS. 4B and 4C, the cells may have a distorted shape. In this case, the diameters of true circles having the same areas as those of the cells are regarded as the outer diameters of the cells. Here, in the embodiment, the cells constituting the elastic layer 53 preferably have an outer diameter of 150 to 450 μm. In the embodiment, the cells of the front layer of the elastic layer 53 have a diameter of 300 μm.

(Method for Measuring Resistance Value of Surface of Transfer Roller 50)

Figure 5:
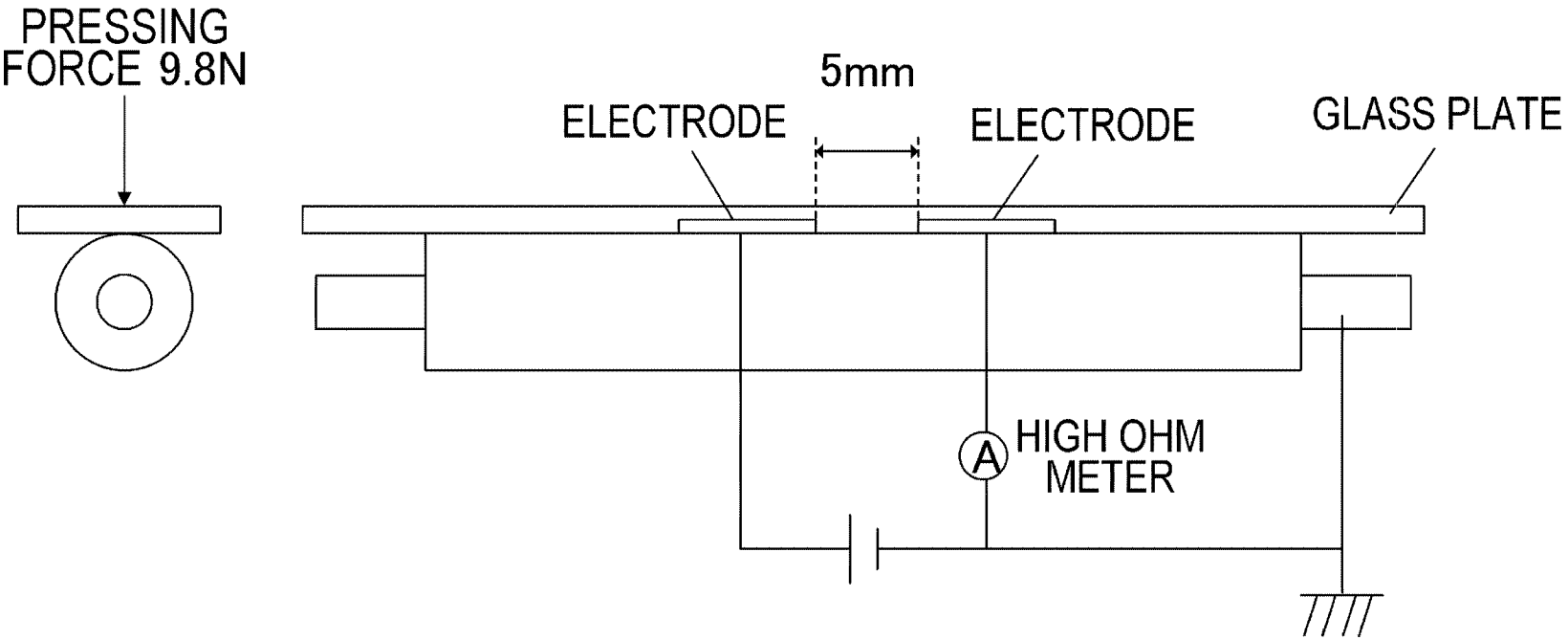
FIG. 5 is a view showing a method for measuring a resistance value of the surface of the transfer roller according to the first embodiment.

Next, a description will be given of a method for measuring a resistance value of the surface of the transfer roller 50. FIG. 5 is a view showing the method for measuring a resistance value of the surface of the transfer roller 50 according to the first embodiment. Note that the resistance value is measured under a temperature of 15° C. and a humidity of 10%. In the measurement of the resistance value of the surface of the transfer roller 50, two electrodes are arranged on the surface of the transfer roller 50 with a constant interval therebetween. A high ohm meter R8340A (manufactured by Advantest Corporation) is connected to the two electrodes to measure a surface resistance Rs (Ω) of the transfer roller 50. In addition, the two electrodes are copper electrodes and presses the transfer roller 50 with a force of 9.8 N. Moreover, the two electrodes are separated from each other by a distance of 5 mm and have a width of 20 mm. More specifically, the two electrodes face each other in the axial direction of the transfer roller 50 and are arranged on the surface of the transfer roller 50 with an interval of 5 mm therebetween. When arranged on the transfer roller 50, the two electrodes have a width of 20 mm in the circumferential direction of the transfer roller 50. As the settings of the high ohm meter R8340A, a voltage of 1000 V was applied to the high ohm meter R8340A, and the surface resistance Rs (Ω) of the transfer roller 50 was measured for 10 seconds under a resistance measurement mode (Normal mode). The surface resistance Rs (Ω) is an electric resistance value of the surface of the transfer roller 50 when a current is fed between the two electrodes. In the embodiment, the transfer roller 50 preferably has a surface resistance Rs of $3.0\times10^{9}$ to $1.0\times10^{13}\Omega$. Therefore, in the embodiment, the transfer roller 50 has a surface resistance Rs of $9.0\times10^{11}\Omega$.

(Method for Measuring Resistance Value in Radial Direction of Transfer Roller 50)

Figure 6:
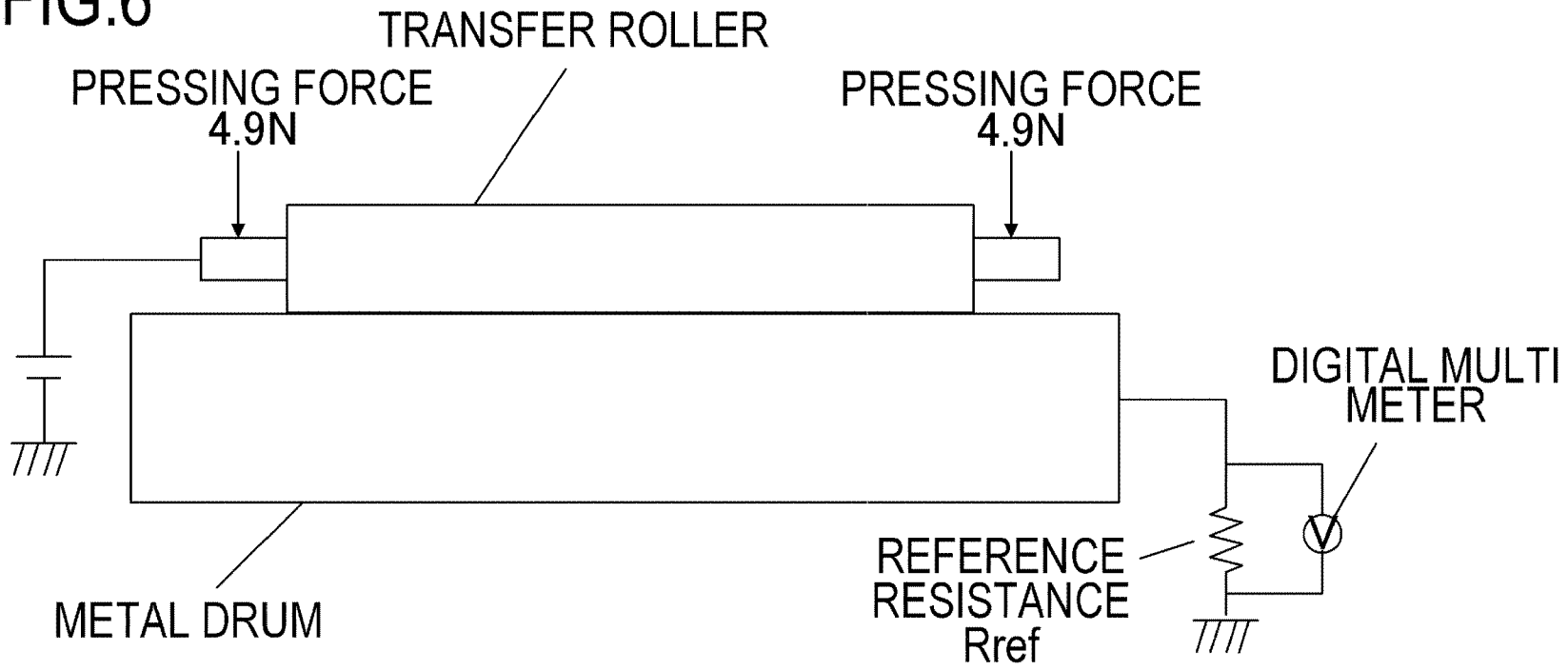
FIG. 6 is a view showing a method for measuring a resistance value in the radial direction of the transfer roller according to the first embodiment.

Next, a description will be given of a method for measuring a resistance value in the radial direction of the transfer roller 50. FIG. 6 is a view showing the method for measuring a resistance value in the radial direction of the transfer roller 50 according to the first embodiment. Note that the resistance value was measured under a temperature of 15° C. and a humidity of 10%. In addition, both ends of the core bar 51 are each pressed toward the metal drum with a force of 4.9 N. Thus, the transfer roller 50 is pressed against the metal drum with a force of 9.8 N. In this state, a voltage Vref applied to a reference resistance Rref when a voltage V1 is applied to the core bar 51 is measured using a digital multi meter (manufactured by FLUKE Corporation). In the measurement, the voltage V1 applied to the core bar 51 is 2000 V, the reference resistance Rref is 1000Ω, and the voltage applied to the reference resistance Rref is measured for 10 seconds after 10 seconds elapse since the application of the voltage to the core bar 51. Further, an average of the voltages applied for 10 seconds is the voltage Vref. In addition, when a current value fed to the reference resistance Rref is Iref, a voltage applied to the transfer roller 50 is Vrol, and a current fed to the transfer roller 50 is Irol, a resistance value Rm in the radial direction of the transfer roller 50 is calculated by the following formula.

$$Rm = Vrol/Irol \quad \text{(Formula 1)}$$

Here, Vrol and Irol are calculated by the following formulae.

$$Vrol = V1 - Vref \quad \text{(Formula 2)}$$

$$Irol = Rref/Vref \quad \text{(Formula 3)}$$

Here, when (Formula 2) and (Formula 3) are substituted into (Formula 1), the following formula is obtained.

$$Rm = (V1 - Vref) \times Verf/Rref$$

Therefore, the resistance value Rm in the radial direction of the transfer roller 50 may be calculated with the measurement of the voltage Vref. Note that in the embodiment, the transfer roller 50 preferably has a resistance value Rm of $2.0\times10^{7}$ to $5.0\times10^{9}\Omega$ in the radial direction. Therefore, in the embodiment, the transfer roller 50 has a resistance value Rm of $3.0\times10^{8}\Omega$ in the radial direction.

(Amount of Charges Applied onto Recording Member P and Force with which Recording Member P Retains Toner)

As described above, in the embodiment, the photosensitive drum 1 is charged to have a negative polarity, and developed toner is also charged to have a negative polarity. In addition, a voltage having a positive polarity opposite to that of the toner is applied to the transfer roller 50, and charges having a positive polarity are applied onto the rear surface of the recording member P when a discharge occurs between the transfer roller 50 and the recording member P. Thus, a toner image is electrostatically transferred from the photosensitive drum 1 onto the recording member P.

At this time, a force with which the recording member P retains the toner image is determined based on the amount of charges obtained by subtracting the amount of charges having a negative polarity on the surface of the recording member P from the amount of charges having the positive polarity on the rear surface of the recording member P after the recording member P passes through the transfer nip portion Nt. That is, the recording member P may stably retain the toner image when the amount of the charges having the positive polarity on the rear surface of the recording member P is larger than the amount of the charges having the negative polarity on the surface of the recording member P. Here, the amount of the charges on the rear surface of the recording member P after the recording member P passes through the transfer nip portion Nt is determined based on the amount of the discharge from the transfer roller 50 to the recording member P. The amount of the charges on the surface of the recording member P is the sum of the amount of the charges having the negative polarity of the toner and the amount of the charges having the negative polarity applied from the photosensitive drum 1 onto the recording member P. Note that the amount of the charges having the negative polarity applied from the photosensitive drum 1 onto the recording member P is determined based on the amount of the discharge occurring between the photosensitive drum 1 and the recording member P on the downstream side of the transfer nip portion Nt in the transporting direction of the recording member P.

Therefore, in order to increase the force with which the recording member P retains the toner image, it is only necessary to increase the amount of the charges having the positive polarity applied onto the rear surface of the recording member P or decrease the amount of the charges having the negative polarity applied onto the surface of the recording member P. Here, in order to increase the amount of the charges having the positive polarity applied onto the rear surface of the recording member P, it is only necessary to increase the voltage applied to the transfer roller 50 to increase the amount of the discharge occurring between the transfer roller 50 and the recording member P. However, if the voltage applied to the transfer roller 50 is excessively increased, the polarity of the toner once transferred onto the recording member P may be inverted and caused to have the same polarity as that of the voltage applied to the transfer roller 50. In this case, there is a likelihood that a phenomenon so-called "re-transfer" in which the toner with its polarity inverted is transferred from the recording member P onto the photosensitive drum 1 again occurs with an image failure such as a lacked toner image. In addition, since it is necessary to upsize a high-voltage substrate to apply a high voltage to the transfer roller 50, there is a likelihood that the image forming apparatus M is upsized or the manufacturing costs of the image forming apparatus M are increased.

Therefore, in order to increase the amount of the charges applied onto the rear surface of the recording member P while preventing the "re-transfer," the upsize of the high-voltage substrate, or the like, the elastic layer provided on the transfer roller 50 is conventionally foamed to have a cell structure near the surface of the transfer roller 50. Thus, the outer diameters of the cells constituting the foaming material are increased near the surface of the elastic layer of the transfer roller 50. The interval between the recording member P and the transfer roller 50 may be increased at the transfer nip portion Nt with an increase in the cell diameter. Therefore, since the amount of the discharge occurring between the recording member P and the transfer roller 50 is increased, the amount of the charges applied onto the rear surface of the recording member P may be increased. As a result, the force with which the recording member P retains a toner image is increased, and an excellent image with no image failure may be obtained.

However, when the cell diameter of the elastic layer 53 of the transfer roller 50 is increased, a difference in the intensity of the discharge occurring between the transfer roller 50 and the recording member P becomes large. As a result, a toner image is disordered when transferred from the photosensitive drum 1 onto the recording member P. Particularly, as for a half-tone image, a toner image is disordered when transferred onto the recording member P, and unnecessary shading (commonly known as "roughness") appears in the half-tone image. Therefore, in order to prevent the shortage of the force with which the recording member P retains the toner while suppressing an image failure, it is preferable to decrease the amount of the charges having the negative polarity applied onto the surface of the recording member P.

(Relationship Between Force with Which Recording Member P Retains Toner and Rs/Rm)

As described above, the amount of the charges having the negative polarity applied onto the surface of the recording member P after the recording member P passes through the transfer nip portion Nt is determined based mainly on the amount of the discharge occurring between the photosensitive drum 1 and the recording member P on the downstream side of the transfer nip portion Nt in the transporting direction of the recording member P. At this time, in order to decrease the amount of the charges having the negative polarity applied onto the surface of the recording member P, it is only necessary to weaken an electric field occurring between the photosensitive drum 1 and the recording member P. Thus, the discharge occurring between the photosensitive drum 1 and the recording member P may be suppressed on the downstream side of the transfer nip portion Nt in the transporting direction of the recording member P. In order to weaken the electric field occurring between the photosensitive drum 1 and the recording member P, it is only necessary to decrease the potential of the surface of the transfer roller 50 and decrease a difference in the potential between the transfer roller 50 and the photosensitive drum 1 on the downstream side of the transfer nip portion Nt in the transporting direction of the recording member P.

Figure 7:
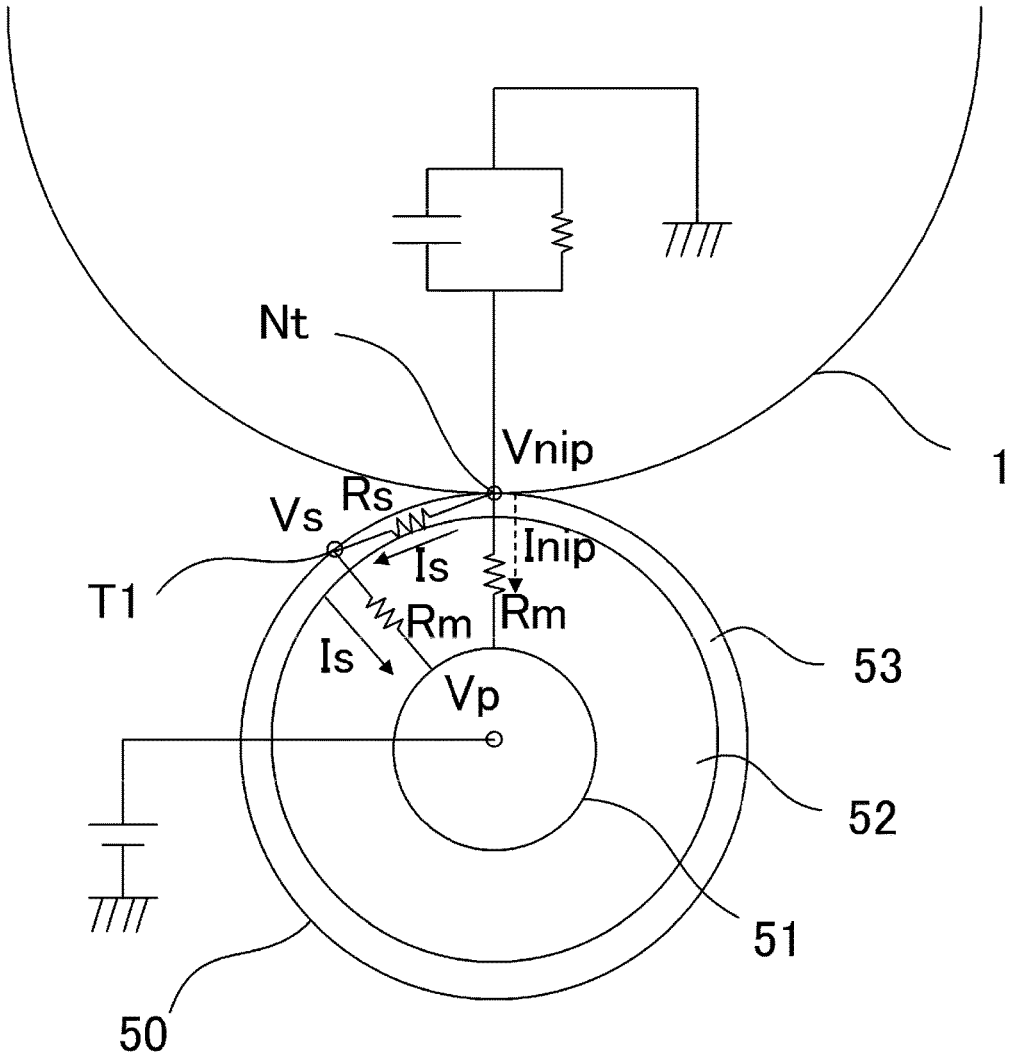
FIG. 7 is a view showing the relationship between a surface potential, a surface resistance Rs, and a resistance value Rm of the transfer roller.

Here, a description will be given of the relationship between the surface potential of the transfer roller 50, the surface resistance Rs of the transfer roller 50, and the resistance value Rm in the radial direction of the transfer roller 50 on the downstream side of the transfer nip portion Nt in the transporting direction of the recording member P. FIG. 7 is a view showing the relationship between the surface potential, the surface resistance Rs, and the resistance value Rm of the transfer roller 50. As shown in FIG. 7, a voltage applied to the core bar of the transfer roller 50 is a voltage Vp and a potential at a point T1 on the downstream side of the transfer nip portion Nt in the transporting direction of the recording member P is a potential Vs. In addition, the surface potential of the transfer roller 50 at the transfer nip portion Nt is a potential Vnip, a current fed from the transfer nip portion Nt to the core bar 51 is a current value Inip, and a current fed from the transfer nip portion Nt to the core bar 51 via the point T1 is a current Is. In this case, the following formulae are established.

$$Vs=Vp-Rm\times Is \quad \text{(Formula 4)}$$

$$V\text{nip}=Vp-(Rm+Rs)\times Is \quad \text{(Formula 5)}$$

From the above two formulae, the following formula may be obtained.

$$Vs=Vp-(Vp-V\text{nip})/(1+Rs/Rm) \quad \text{(Formula 6)}$$

As shown in the above Formula 6, it is only necessary to decrease Rs/Rm in order to decrease the potential Vs at the point T1. That is, when the surface resistance Rs of the transfer roller 50 is decreased with respect to the resistance value Rm in the radial direction of the transfer roller 50, the electric field between the photosensitive drum 1 and the recording member P is weakened at the point T1, whereby the amount of the discharge from the photosensitive drum 1 to the recording member P is decreased. As a result, the amount of the charges having the negative polarity on the surface of the recording member P is decreased after the recording member P passes through the transfer nip portion Nt. Thus, the force with which the recording member P retains the toner is increased. Therefore, in the embodiment, the relationship between the surface resistance Rs and the resistance value Rm of the transfer roller 50 is set as Rs/Rm=3000.

Function and Effect of Embodiment

In order to confirm the effect of the embodiment, a letter-sized Business 4200 (hereinafter called a letter sheet) manufactured by Xerox Corporation was used as the recording member P. In addition, a letter sheet left to stand for 48 hours in a low temperature and low humidity environment of a temperature of 15° C. and a humidity of 10% was used as the recording member P. Then, a half-tone image was successively printed on ten sheets to confirm the presence or absence of the occurrence of an image failure. Moreover, the voltage applied to the transfer roller 50 was 2000 V.

Here, in this experiment, a transfer roller in which Rs/Rm was 9000 ($Rs=2.7\times10^{12}\Omega$, $Rm=3.0\times10^{8}\Omega$) was used as Comparative Example 1. In addition, the transfer roller 50 in which the value of Rs/Rm was smaller than that of Comparative Example 1 was used as the embodiment. Note that the transfer roller 50 in which Rs/Rm was 3000 ($Rs=9.0\times10^{11}\Omega$, $Rm=3.0\times10^{8}\Omega$) was used as the embodiment. Note that the transfer rollers in which the elastic layer 53 had a cell diameter of 300 μm were used as the embodiment and Comparative Example 1. Further, in the experiment, a transfer roller in which an elastic layer 53 had a cell diameter larger than those of the embodiment and Comparative Example 1 was used as Conventional Example 1. Specifically, the transfer roller in which the elastic layer 53 had a cell diameter of 500 μm and Rs/Rm is 9000 ($Rs=2.7\times10^{12}\Omega$, $Rm=3.0\times10^{8}\Omega$) was used as a conventional example 1.

The results of the experiment are shown in Table 1. Here, as for each of "roughness" and "scattering," incorrect marks "x" are indicated when "roughness" and "scattering" occurred in even one of the ten printed sheets, and correct marks "o" are indicated when "roughness" and "scattering" did not occur in all the ten printed sheets.

TABLE 1

| | Cell Diameter | Rs/Rm | Roughness | Scattering |
|---|---|---|---|---|
| Embodiment | 300 | 3000 | ○ | ○ |
| Conventional Example 1 | 500 | 9000 | X | ○ |
| Comparative Example 1 | 300 | 9000 | ○ | X |

As shown in Table 1, "scattering" did not occurred in the embodiment and Conventional Example 1, while "scattering" occurred in Comparative Example 1. As described above, the elastic layer 53 has a cell diameter of 300 μm in both the embodiment and Comparative Example 1. However, Rs/Rm is 3000 in the embodiment, while Rs/Rm is 9000 in Comparative Example 1. In the embodiment, it appears that the discharge from the photosensitive drum 1 to the surface of the recording member P was suppressed on the downstream side of the transfer nip portion Nt in the transporting direction of the recording member P, whereby the amount of the charges having the negative polarity applied onto the surface of the recording member P was decreased. Thus, it appears that the force with which the recording member P retained the toner was increased, whereby the occurrence of "scattering" was suppressed. In addition, the value of Rm/Rs is the same between Comparative Example 1 and Conventional Example 1. However, the elastic layer 53 has a cell diameter of 500 μm in Conventional Example 1, while the elastic layer 53 has a cell diameter of 300 μm in Comparative Example 1. Therefore, it appears that the amount of the discharge from the transfer roller 50 to the recording member P was increased at the transfer nip portion Nt, and that the amount of the charges having the positive polarity applied onto the rear surface of the recording member P was increased. Therefore, it appears that the force with which the recording member P retained the toner was improved, and that the occurrence of "scattering" was suppressed.

Next, as for "roughness," excellent results were obtained in the embodiment and Comparative Example 1. However, "roughness" occurred in Conventional Example 1. The elastic layer 53 has a cell diameter of 300 μm in both the embodiment and Comparative Example 1, while the elastic layer 53 has a cell diameter of 500 μm in Conventional Example 1. Thus, it appears that the difference in the intensity of the discharge from the transfer roller 50 to the recording member P occurred at the transfer nip portion Nt to cause "roughness." In the embodiment, the occurrence of "roughness" was suppressed with a decrease in the value of Rs/Rm, and the occurrence of "scattering" was suppressed with an increase in the force with which the recording member P retains the toner.

Figure 8:
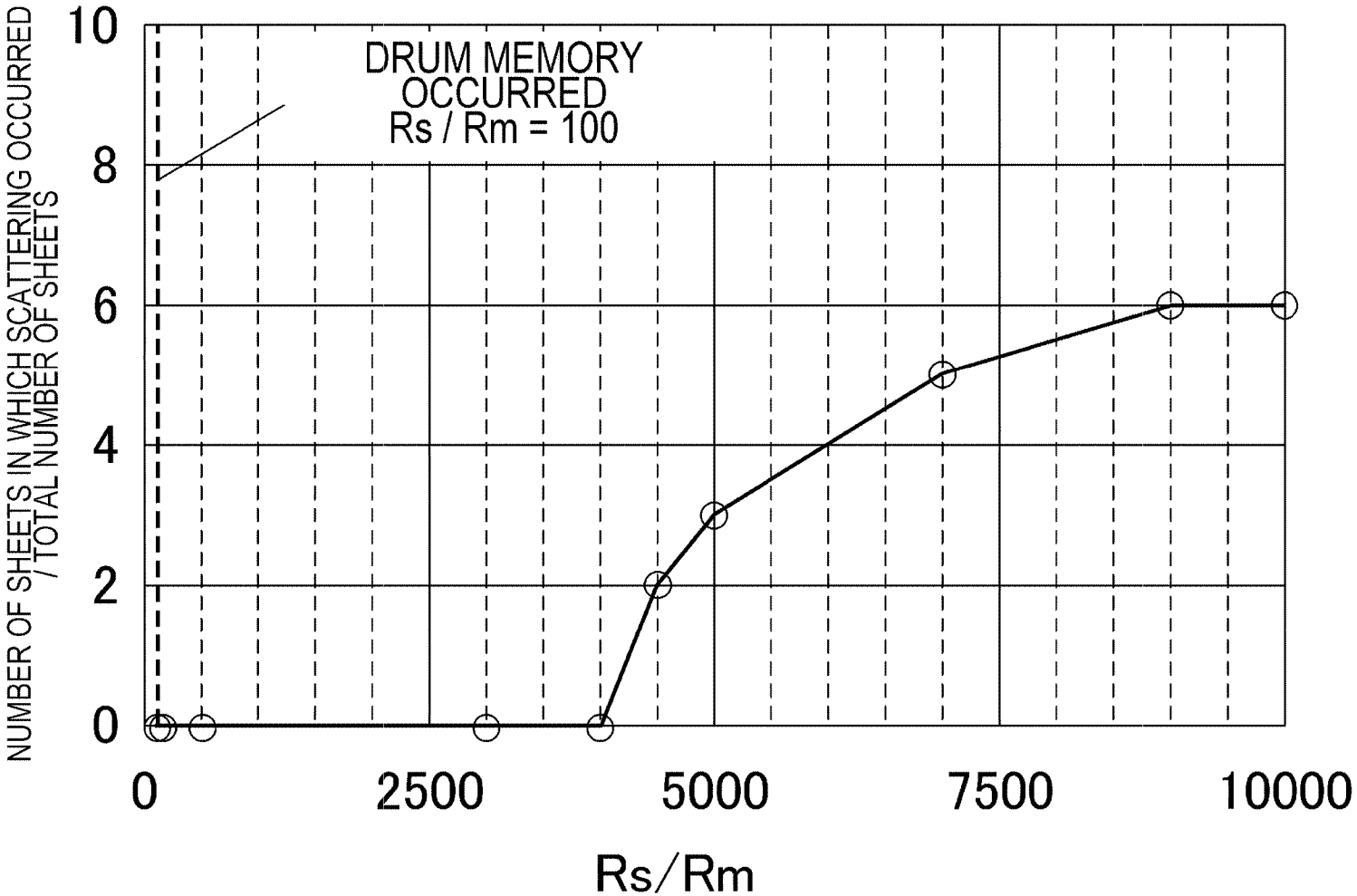
FIG. 8 is a diagram showing the relationship between the number of sheets in which "scattering" occurred and Rs/Rm in the first embodiment.

Next, the value of Rs/Rm with which an image failure may be suppressed will be discussed. FIG. 8 is a diagram showing the relationship between the number of sheets in which "scattering" occurred and Rs/Rm in the first embodiment. In a verification experiment, a letter sheet left to stand for 48 hours in a low temperature and low humidity environment of a temperature of 15° C. and a humidity of 10% was used as the recording member P. Then, a half-tone image was successively printed on ten sheets to confirm the presence or absence of an image failure. In addition, in the verification experiment, the transfer roller 50 was set such that the cell diameter of the elastic layer 53 was 300 μm, the surface resistance Rs was $1.5\times10^{10}$ to $3.0\times10^{12}\Omega$, the resistance value Rm was $3.0\times10^{8}\Omega$, and Rs/Rm was 50 to 10,000. As shown in FIG. 8, the smaller the value of Rs/Rm, the more "scattering" was suppressed. When Rs/Rm was 4000, the occurrence of "scattering" was not confirmed.

Meanwhile, when Rs/Rm was 100, an image failure occurred due to the shortage of the charges on the surface of the photosensitive drum 1 charged by the charging roller 2 (commonly known as "drum memory"). Specifically, when Rs/Rm is 100, a large current flows into the non-sheet feeding portion of the photosensitive drum 1 (the portion of the photosensitive drum 1 with which the recording member P is not brought into contact) from the transfer roller 50 in a state in which the recording member P exists at the transfer nip portion Nt. Therefore, the charges having the positive polarity are applied onto the photosensitive drum 1 in large amounts, and the potential of the surface of the photosensitive drum 1 does not become a desired potential after the photosensitive drum 1 is charged by the charging roller 2. In the image forming apparatus M according to the embodiment, a potential Vd of the dark portion (the portion not irradiated with laser L) of the photosensitive drum 1 desirably becomes −600 V after the photosensitive drum 1 is charged by the charging roller 2. However, when Rs/Rm is 100, the potential Vd of the dark portion of the photosensitive drum 1 becomes, for example, only −450 V or so. Therefore, the potential difference |Vback| between a potential Vc of the bright portion (the portion irradiated with the laser L) of the photosensitive drum 1 and the potential Vd of the dark portion thereof becomes 100 V. In this case, since the value of the potential difference |Vback| is small, the toner also adheres to the dark portion of the photosensitive drum 1, whereby an image failure may occur. When Rs/Rm is small, "drum memory" occurs. Note that in the embodiment, "drum memory" did not occur when Rs/Rm was 150 in the verification experiment.

As described above, in the embodiment, the pair of electrodes face each other in the axial direction of the transfer roller 50 and are arranged on the surface of the transfer roller 50 with an interval of 5 mm therebetween. In addition, the two electrodes have a width of 20 mm in the circumferential direction of the transfer roller 50 when arranged on the transfer roller 50. Further, the surface resistance of the transfer roller 50 when a current is fed between the electrodes in this state is Rs (Ω). In addition, when a current is fed from the core bar 51 to the outer peripheral surface of the elastic layer 53, the combined resistance of the elastic layer 52 and the elastic layer 53 is Rm (Ω). In this case, the relationship 150≤Rs (Ω)/Rm (Ω)≤4000 is established in an environment of a temperature of 15° C. and a humidity of 10%. Thus, the discharge occurring between the photosensitive drum 1 and the recording member P may be suppressed, and the recording member P may be caused to reliably retain a toner image transferred onto the recording member P.

Moreover, in the embodiment, the transfer roller 50 has an outer diameter of 8 mm to 15 mm. Thus, an increase in the manufacturing costs of the transfer roller 50 or the upsize of the image forming apparatus M may be suppressed.

Furthermore, in the embodiment, the elastic layer 53 is made of a foaming material, and the cells constituting the foaming material in the elastic layer 53 have an average outer diameter of 150 μm to 450 μm. Here, if the cell diameter is too large, the discharge becomes sparse and the shading of an image also becomes sparse. On the other hand, if the cell diameter is too small, the discharge is not promoted between the transfer roller 50 and the recording member P, whereby the amount of the charges applied onto the rear surface of the recording member P is decreased. In the embodiment, the above problems may be suppressed since the cells have an average outer diameter of 150 μm to 450 μm.

Second Embodiment

A description will be given of a second embodiment. Unlike the first embodiment, the elastic layer of a transfer roller 60 in the second embodiment is constituted by only one elastic layer 62. Here, in the second embodiment, portions having the same functions as those of the first embodiment will be denoted by the same symbols, and their descriptions will be omitted.

(Configuration of Transfer Roller 60)

Figure 9:
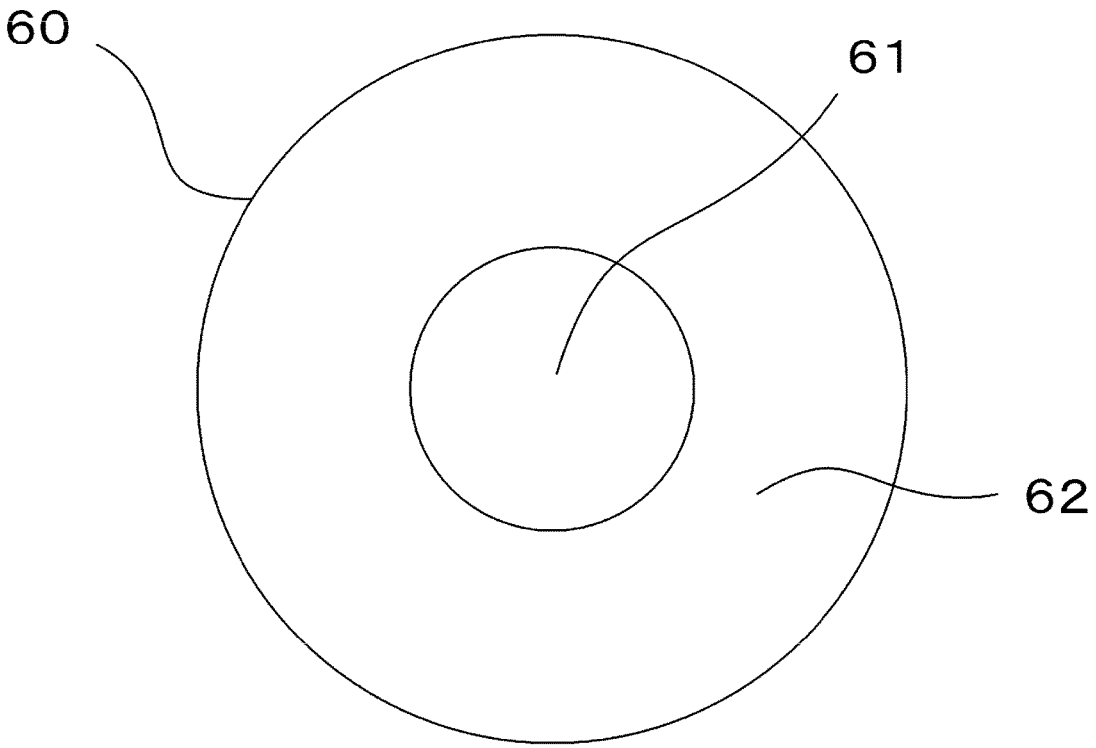
FIG. 9 is a cross-sectional view of a transfer roller according to a second embodiment.

FIG. 9 is a cross-sectional view of the transfer roller 60 according to the second embodiment. As shown in FIG. 9, the transfer roller 60 is constituted by a core bar 61 and the cylindrical elastic layer 62 that surrounds the outer peripheral surface of the core bar 61. The transfer roller 60 has a length of 216 mm in its longitudinal direction (rotational center axial direction), the core bar 61 has an outer diameter φ of 5 mm, the elastic layer 62 has a thickness of 3.75 mm. In addition, the elastic layer 62 is an elastic member made of a foaming material, and cells in a layer near the surface of the elastic layer 62 have a diameter of 300 μm. Moreover, the transfer roller 60 presses a photosensitive drum 1 with a force of 9.8 N (1 kgf).

In the embodiment, the transfer roller 60 has the only one elastic layer 62, and the value of Rs/Rm may be decreased with the adjustment of a vulcanization condition for manufacturing the transfer roller 60. Note that when the transfer roller 60 has only one elastic layer, the value of Rs/Rm may be decreased even with an increase in the thickness of the elastic layer and an increase in the value of Rm. In this case, however, the transfer roller is caused to have a larger outer diameter, which results in a likelihood that the manufacturing costs of the transfer roller are increased or an image forming apparatus is upsized. Therefore, the transfer roller 60 preferably has an outer diameter of 8 mm to 15 mm. Thus, in the embodiment, the transfer roller 60 has an outer diameter of 12.5 mm.

Function and Effect of Second Embodiment

In order to confirm the effect of the second embodiment, a letter-sized Business 4200 (letter sheet) manufactured by Xerox Corporation was used as a recording member P.

Specifically, in a verification experiment, a letter sheet left to stand for 48 hours in a low temperature and low humidity environment of a temperature of 15° C. and a humidity of 10% was used as the recording member P. Then, a half-tone image was successively printed on ten sheets to confirm the presence or absence of an image failure. In addition, a voltage applied to the transfer roller 60 was 2000 V. Moreover, the cell outer diameter of the elastic layer 62 was 300 μm, the surface resistance Rs was $1.5\times10^{10}$ to $3.3\times10^{12}$Ω, the resistance value Rm was $3.0\times10^{8}$Ω, and Rs/Rm was 50 to 10,000. Under the conditions, the presence or absence of "scattering" and "drum memory" was confirmed.

Figure 10:
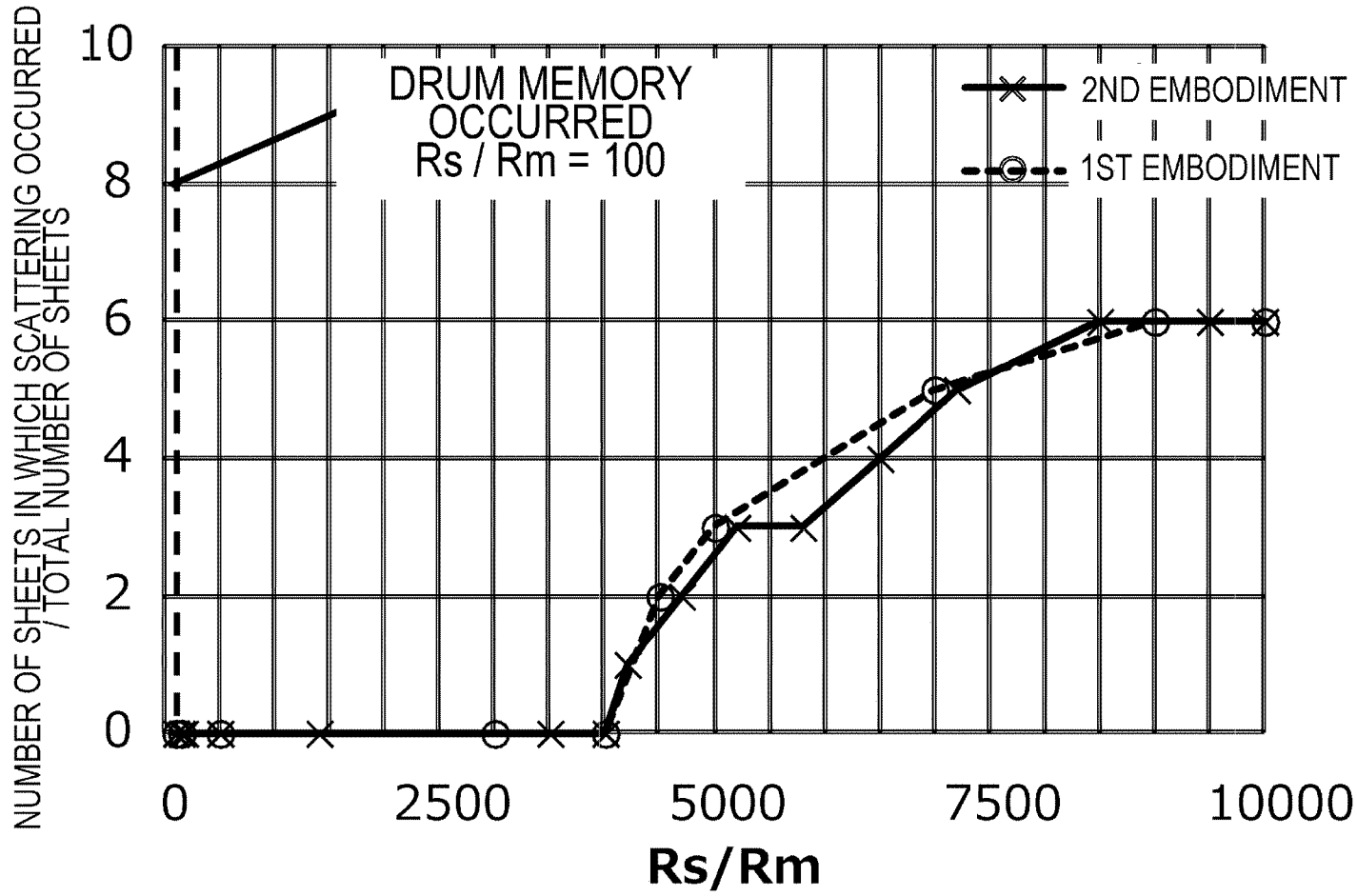
FIG. 10 is a diagram showing the relationship between the number of sheets in which "scattering" occurred and Rs/Rm in the second embodiment.

FIG. 10 is a diagram showing the relationship between the number of sheets in which "scattering" occurred and Rs/Rm in the second embodiment. In FIG. 10, a solid line indicates the experimental results of the embodiment, and dashed lines indicate the experimental results of the first embodiment. As shown in FIG. 10, the smaller the value of Rs/Rm, the more "scattering" was suppressed in the embodiment similarly to the first embodiment. When Rs/Rm was 4000, the occurrence of "scattering" was not confirmed. In addition, "drum memory" did not occur when Rs/Rm was 150 but occurred when Rs/Rm was 100. From the results, it appears that the amount of charges having a negative polarity applied onto the surface of the recording member P may be decreased with a decrease in the value of Rs/Rm even when the transfer roller 60 has the one elastic layer 62 as in the second embodiment.

Note that in the embodiment, the cell diameter of the elastic layer 62 may be increased so long as the value of Rs/Rm falls within the range of 150 to 4000. However, if the cell diameter of the elastic layer 62 is excessively increased, "roughness" occurs. For example, when the cell diameter of the elastic layer 62 is 500 μm and Rs/Rm is 3000, the occurrence of "scattering" is suppressed but "roughness" occurs. In the embodiment, the elastic layer 62 of the transfer roller 60 preferably has a cell diameter of 150 to 450 μm. Further, the value of Rs/Rm is preferably 150 to 4000.

Third Embodiment

Figure 11A:
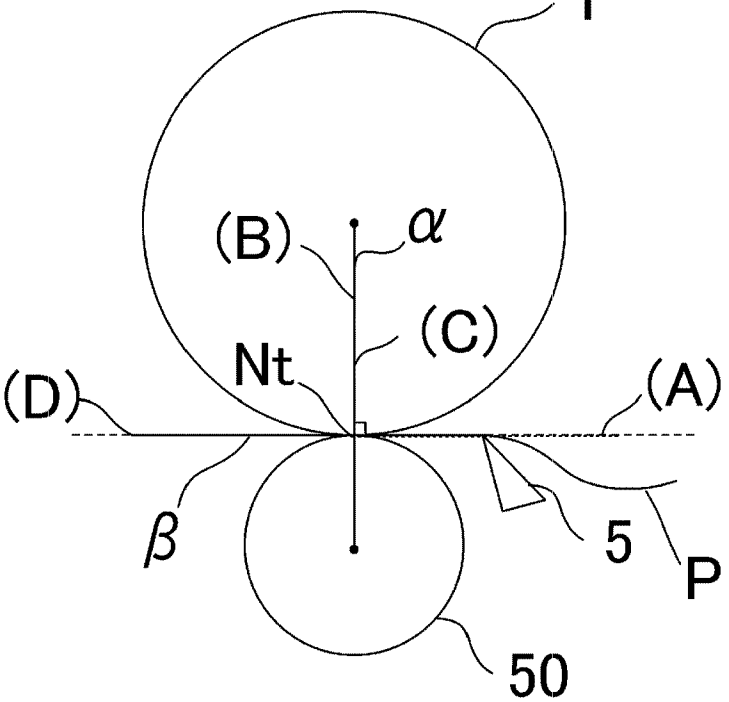
FIGS. 11A and 11B are views each showing the transfer nip portion between a photosensitive drum and a transfer roller according to a third embodiment.
Figure 11B:
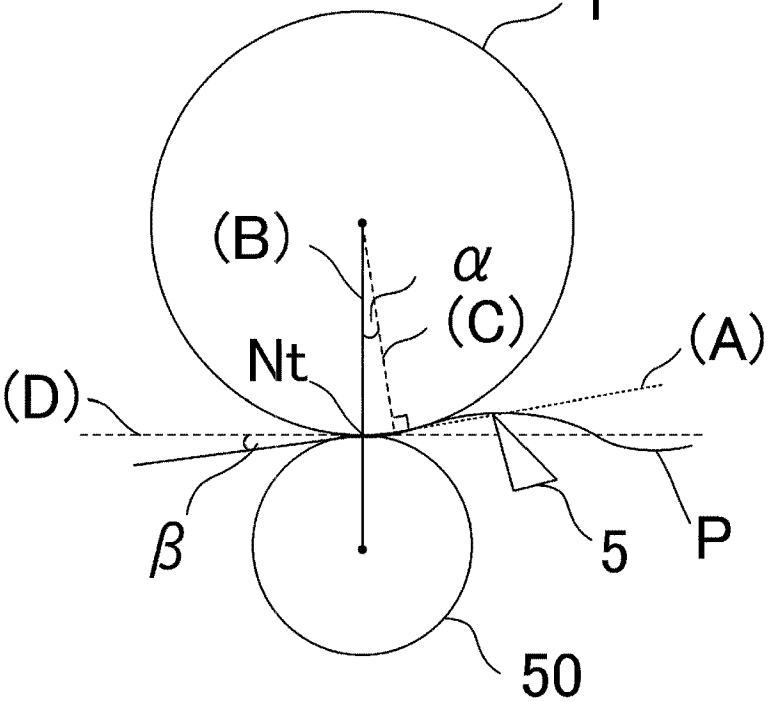

A description will be given of a third embodiment. In the embodiment, a recording member P is configured to wind around a photosensitive drum 1 on the upstream side of a transfer nip portion Nt in the transporting direction of the recording member P. The recording member P is transported to the transfer nip portion Nt so as to wind around the photosensitive drum 1. Here, FIGS. 11A and 11B are views each showing the transfer nip portion Nt between the photosensitive drum 1 and the transfer roller 50 according to the third embodiment. In FIG. 11A, an angle (winding angle α (see FIG. 2)) at which the recording member P winds around the photosensitive drum 1 is small, and a transfer separating angle β (see FIG. 2) is small. On the other hand, in FIG. 11B, the winding angle α is large, and the transfer separating angle β is large. Here, the winding angle α and the transfer separating angle β are defined as described above.

In the embodiment, as shown in FIG. 11B, an angle at which the recording member P enters the transfer nip portion Nt is increased with a change in the position of a pre-transfer guide 5. Thus, the winding angle α at which the recording member P winds around the photosensitive drum 1 is increased. In this case, the transfer separating angle β is also increased on the downstream side of the transfer nip portion Nt in the transporting direction of the recording member P. This is because the transfer roller 50 is pressed by the recording member P in a direction opposite to a direction in which the transfer roller 50 presses the photosensitive drum 1 due to the elasticity of the recording member P.

Here, when the transfer separating angle β is increased, the distance between the photosensitive drum 1 and the recording member P is increased on the downstream side of the transfer nip portion Nt in the transporting direction of the recording member P, whereby a discharge from the photosensitive drum 1 to the recording member P is intensified. As a result, the amount of charges having a negative polarity applied from the photosensitive drum 1 onto the recording member P is increased, and a force with which the recording member P retains toner is decreased. For this reason, there is a likelihood that an image failure occurs.

In the embodiment, the occurrence of an image failure may be suppressed with the adjustment of the value of Rs/Rm even when the transfer separating angle β is increased and the amount of the charges having the negative polarity applied onto the surface of the recording member P is increased. In the embodiment, the position of the pre-transfer guide 5 and the winding angle α are different from those of the first embodiment, but the other configurations are the same. In addition, the quality of an image is improved if the winding angle α is large, but the recording member P may not be properly transported if the winding angle α is too large. It is generally said that the winding angle α is preferably 0° to 20°. Therefore, in the embodiment, the winding angle α is 15°.

Function and Effect of Third Embodiment

In order to confirm the effect of the embodiment, a letter-sized Business 4200 (hereinafter called a letter sheet) manufactured by Xerox Corporation was used as a recording member. Specifically, a letter sheet left to stand for 48 hours in a low temperature and low humidity environment of a temperature of 15° C. and a humidity of 10% was used as the recording member P. Then, a half-tone image was successively printed on ten sheets to confirm the presence or absence of an image failure. At this time, a voltage applied to the transfer roller 50 was 2000 V. In the embodiment, the cell diameter of an elastic layer 53 of the transfer roller 50 was 300 μm, the surface resistance Rs was $1.5\times10^{10}$ to $3.0\times10^{12}\Omega$, the resistance value Rm was $3.0\times10^{8}\Omega$, and Rs/Rm was 50 to 10,000 like the first embodiment. Under the conditions, the presence or absence of the occurrence of "scattering" and "drum memory" was confirmed.

Figure 12:
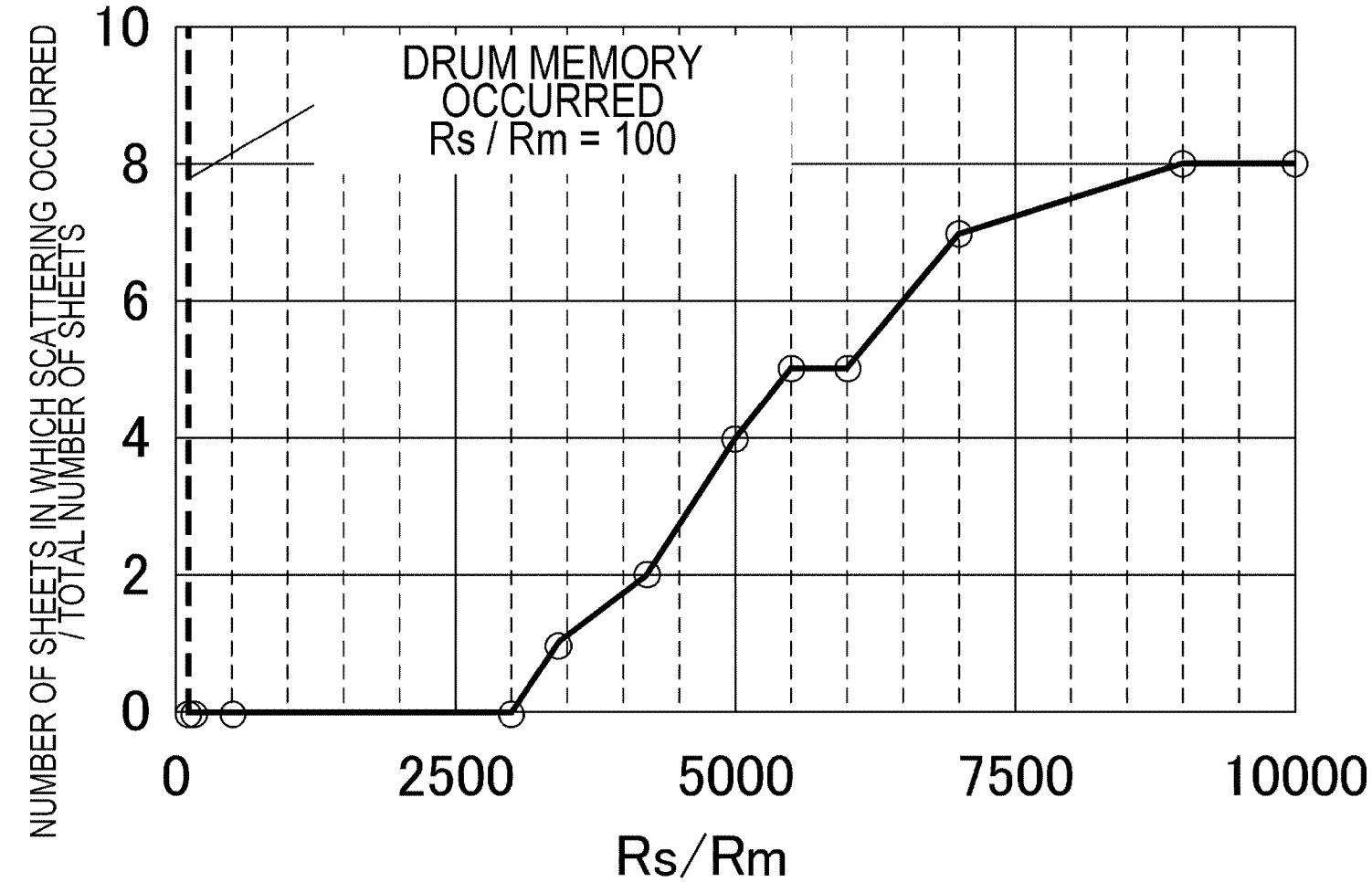
FIG. 12 is a diagram showing the relationship between the number of sheets in which "scattering" occurred and Rs/Rm in the third embodiment.

FIG. 12 is a diagram showing the relationship between the number of sheets in which "scattering" occurred and Rs/Rm in the third embodiment. As shown in FIG. 12, the smaller the value of Rs/Rm, the more "scattering" was suppressed. When Rs/Rm was 3000, the occurrence of "scattering" was not confirmed. In the first embodiment, the occurrence of "scattering" was not confirmed when Rs/Rm was 4000. In the embodiment, however, "scattering" occurred when Rs/Rm was 4000, and the occurrence of "scattering" was not confirmed when Rs/Rm was 3000. In the embodiment, since the winding angle α is 15°, the transfer separating angle β becomes larger than that of the first embodiment, which results in an increase in the amount of the charges having the negative polarity applied onto the surface of the recording member P on the downstream side of the transfer nip portion Nt in the transporting direction of the recording member P. Therefore, it appears that "scattering" occurred since the force with which the recording member P retained toner was weakened. Thus, in the embodiment, the value of Rs/Rm is set at 150 to 3000 to suppress "scattering."

In addition, in the embodiment as well, "drum memory" did not occur when Rs/Rm was 150 but occurred when Rs/Rm was 100. Note that the cell diameter of the elastic layer 53 of the transfer roller 50 may be increased so long as the value of Rs/Rm falls within the range of 150 to 3000. However, if the cell diameter of the elastic layer 53 is excessively increased, there is a likelihood that "roughness" occurs as described above. For example, when the cell diameter of the elastic layer 53 is 500 μm and Rs/Rm is 3000, the occurrence of "scattering" may be suppressed but "roughness" occurs.

In the embodiment, a tangent of which the contact with the photosensitive drum 1 is closer to the transfer nip portion Nt among tangents from the sharp portion of a pre-transfer guide 5 to the outer peripheral surface of the photosensitive drum 1 is a straight line A, and a line segment that connects the center of the photosensitive drum 1 and the center of the transfer roller 50 to each other is a line segment B. In addition, a line segment that connects the contact between the photosensitive drum 1 and the straight line A and the center of the photosensitive drum 1 to each other is a line segment C. At this time, in the embodiment, an angle α (winding angle α) formed by the line segments B and C is indicated as $0° < \alpha < 20°$, and the relationship between Rs (Ω) and Rm (Ω) is indicated as $150 \leq Rs\ (\Omega)/Rm\ (\Omega) \leq 3000$. Thus, the distance between the outer peripheral surface of the photosensitive drum 1 and the recording member P may be increased on the downstream side of the transfer nip portion Nt in the transporting direction of the recording member P.

Note that in each of the embodiments, the resistance values Rs and Rm are adjusted since the transfer roller 50 has a plurality of elastic layers. However, the transfer roller 50 may be constituted by different layers. For example, the transfer roller 50 may be constituted not only by elastic layers but also by different types of layers such as a coat layer and a tube layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-119812, filed on Jun. 16, 2016, which is hereby incorporated by reference herein in its entirety.

What is claimed is:

1. A transfer roller for transferring a developer image formed on a photosensitive drum onto a sheet, the transfer roller comprising:

a conductive core portion:

a first layer that covers the core portion; and a second layer that covers the first layer, wherein the developer image is transferred onto the sheet at a nip portion between the photosensitive drum and the transfer roller when a voltage is applied to the core portion, and a relationship $150 \leq Rs\ (\Omega)/Rm\ (\Omega) \leq 4000$ is established in an environment of a temperature of 15° C. and a humidity of 10% in a case where a surface resistance of the transfer roller is Rs (Ω) when a current is fed between a pair of electrodes facing each other in an axial direction of the transfer roller and arranged on a surface of the transfer roller with an interval of 5 mm therebetween, the electrodes having a width of 20 mm in a circumferential direction of the transfer roller in a state of being arranged on the transfer roller, and in a case where a combined resistance of the first layer and the second layer is Rm (Ω) when the current is fed from the core portion to an outer peripheral surface of the second layer.

2. The transfer roller according to claim 1, wherein a material of the first layer is same as a material of the second layer, and the relationship $150 \leq Rs\ (\Omega)/Rm\ (\Omega) \leq 4000$ is established in the environment of the temperature of 15° C. and the humidity of 10% by adjustment of a condition for vulcanizing the first layer and the second layer.

3. The transfer roller according to claim 1, which has an outer diameter of 8 mm to 15 mm.

4. The transfer roller according to claim 1, wherein the second layer is made of a foaming material, and cells constituting the foaming material have an average outer diameter of 150 μm to 450 μm in the second layer.

5. The transfer roller according to claim 4, wherein when the outer diameter of the cells constituting the foaming material is a diameter of true circles having same areas as the cells constituting the foaming material and is an average of outer diameters of 30 larger cells in a range of 3 mm long by 4 mm broad at a surface of the second layer, the cells have an outer diameter of 150 μm to 450 μm.

6. An image forming apparatus comprising:

the transfer roller according to claim 1; and a photosensitive drum, wherein an image is formed on a sheet when a developer image formed on the photosensitive drum is transferred onto a sheet.

7. The image forming apparatus according to claim 6, wherein the nip portion is formed when an outer peripheral surface of the photosensitive drum and an outer peripheral surface of the transfer roller contact each other, a guide member that guides the sheet so that the sheet enters the nip portion from a side closer to the photosensitive drum than the transfer roller is provided, the sheet is guided when the sheet contacts the guide member, and when a tangent, a contact with the photosensitive drum of which is closer to the nip portion among tangents from a portion closest to the nip portion to the outer peripheral surface of the photosensitive drum among portions at which the guide member and the sheet contact each other is a first line, a line segment that connects a center of the photosensitive drum and a center of the transfer roller to each other is a second line, and a line segment that connects the contact between the photosensitive drum and the first line, and the center of the photosensitive drum to each other is a third line, an angle α formed by the second line and the third line is indicated as $0° < \alpha < 20°$ and a relationship between Rs (Ω) and Rm (Ω) is indicated as $150 \leq Rs\ (\Omega)/Rm\ (\Omega) \leq 3000$.

8. The image forming apparatus according to claim 6, wherein the photosensitive drum is charged to have a negative polarity, a developer for forming the developer image is charged to have a negative polarity, and a voltage applied to the core portion of the transfer roller has a positive polarity.

9. The image forming apparatus according to claim 6, wherein the nip portion is formed when an outer peripheral surface of the photosensitive drum and an outer peripheral surface of the transfer roller contact each other.

* * * * *